United States Patent [19]

Hart et al.

[11] Patent Number: 4,461,340

[45] Date of Patent: Jul. 24, 1984

[54] OIL COOLER

[75] Inventors: Kenneth J. Hart, Pinner; Colin P. Smith, Stalbans, both of England

[73] Assignee: Rolls-Royce Limited, London, England

[21] Appl. No.: 475,744

[22] Filed: Mar. 16, 1983

[30] Foreign Application Priority Data

Mar. 31, 1982 [GB] United Kingdom ..... 8209577

[51] Int. Cl.[3] ..... F01P 7/02

[52] U.S. Cl. ..... 165/39; 123/41.11; 123/41.12

[58] Field of Search ..... 165/39; 123/41.11, 41.12, 123/41.49; 137/92; 236/35

[56] References Cited

U.S. PATENT DOCUMENTS

| | | | |
|---|---|---|---|
| 2,195,697 | 4/1940 | Ellis | 123/41.12 |
| 2,301,665 | 11/1942 | Dykeman et al. | 165/39 |
| 2,349,327 | 5/1944 | Worth | 137/92 |
| 2,359,533 | 10/1944 | Shogran | 165/39 |
| 2,385,060 | 9/1945 | Chapman | 165/39 |
| 2,739,655 | 3/1956 | Petty | 165/39 |

*Primary Examiner*—Allen M. Ostrager

*Attorney, Agent, or Firm*—Cushman, Darby & Cushman

[57] ABSTRACT

An oil cooler comprises a heat exchanger through which the oil passes and which is cooled by a fan. The fan is provided with variable pitch blades so that a variable flow rate of cooling air may be directed on to the heat exchanger. The pitch of the blades is controlled by a piston and cylinder assembly which is actuated by a viscous restrictor located in the oil flow path to the heat exchanger. The arrangement is such that the flow rate of cooling air increases with any decrease in the pressure drop across the viscous restrictor and vice versa.

4 Claims, 3 Drawing Figures

OIL COOLER

This invention relates to an oil cooler and in particular to an oil cooler which cools oil at a rate which is dependent upon the temperature of the oil.

It is common practice to provide oil lubricated machinery with a device to provide oil cooling. This may take the form of a heat exchanger through which the oil flows and which is adapted to bring the oil into heat exchange relationship with a flow of cooling air. The cooling air flow is frequently provided by a fan which is driven so as to direct cooling air on to the heat exchanger. In order to ensure that the oil passing through the heat exchanger is adequately cooled under all operating conditions of the machine, the flow rate of cooling air through the heat exchanger must be such as to provide effective oil cooling when the oil entering the heat exchanger is at its hottest. Unfortunately this means that when the oil entering the heat exchanger is not at its hottest, there is a tendency for the oil to be overcooled, thereby resulting in an increase in its viscosity.

Oil overcooling is generally undesirable in most forms of machinery in view of the mechanical losses which result from its high viscosity. Other undesirable effects may be evident if the machinery is an internal combustion engine. The efficiency of such engines is dependent to a certain extent upon the temperature at which they operate. If those operating temperatures are reduced as a result of oil overcooling, then engine efficiency is correspondingly reduced.

It is an object of the present invention to provide an oil cooler which is cooled by an air flow derived from a driven fan, the air flow rate of which is proportional to the temperature of oil entering the cooler.

According to the present invention, an oil cooler comprises a heat exchanger adapted for the passage of oil therethrough, a variable pitch driven fan which is so positioned as to direct a flow of cooling air on to said heat exchanger to provide cooling of any oil passing therethrough, and a viscous restrictor through which said oil is passed, the inlet and outlet of said viscous restrictor being connected in parallel with detection means adapted to detect the oil pressure drop across said viscous restrictor and provide an output signal to said fan which is proportional to said pressure drop and serves to cause a variation in the pitch of said fan, the arrangement being such that in operation the pitch of said fan is varied in such a manner that the flow rate of cooling air directed on to said heat exchanger increases with any decrease in the pressure drop across said viscous restrictor and vice versa.

Said detection means preferably comprises a cylinder having a piston translation therein, each side of said piston being in communication with oil which is respectively in communication with the inlet and outlet of said viscous restrictor, said piston also being in communication with the pitch changing mechanism of said powered fan so that actuation of said piston as a result of changes in the pressure drop across said viscous restrictor serves to cause a variation in the pitch of said fan.

Said viscous restrictor may comprise a member defining an elongate chamber with an inlet and an outlet, said chamber containing a body which, together with the internal walls of said chamber, present a surface area to said oil passing therethrough which is of such a magnitude as to provide a viscous drag upon said oil which is sufficient to provide an oil pressure drop across said restrictor which pressure drop is proportional to the viscosity, and hence temperature, of said oil. Said viscous restrictor may alternatively be constituted by all of part of said heat exchanger.

Said oil cooler may constitute a part of an oil system for a gas turbine engine.

The invention will now be described, by way of example, with reference to the accompanying drawings in which.

Figure 1:
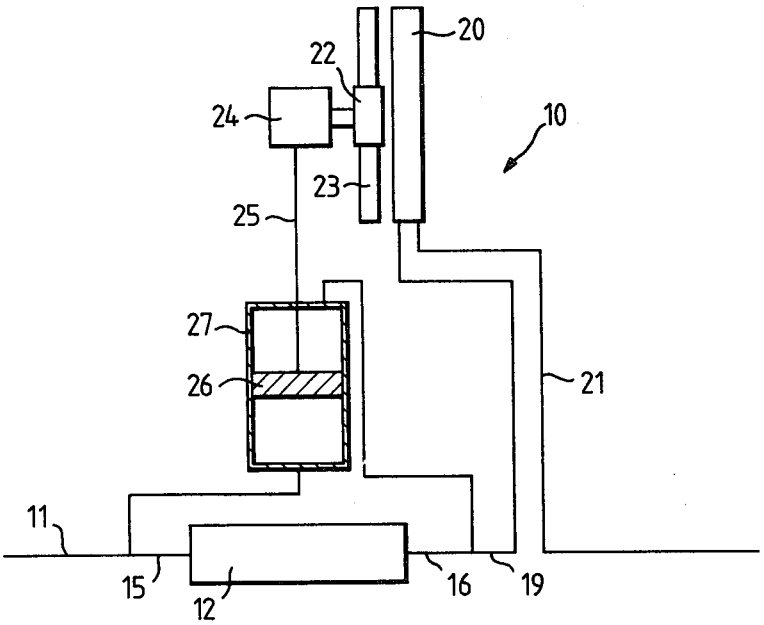
FIG. 1 is a diagrammatic representation of an oil cooler in accordance with the present invention.
Figure 3:
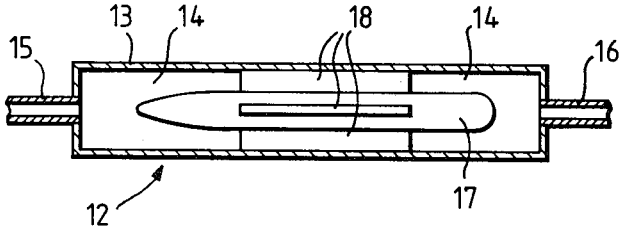
FIG. 3 is a sectioned side view of a viscous restrictor suitable for use with the oil cooler shown in FIG. 1 and 2.

With reference to FIG. 1 an oil cooler generally indicated at 10 is supplied through a pipe 11 with oil which has been derived from, for instance, the oil system of a gas turbine engine. The oil flows along the pipe 11 into a viscous restrictor 12, the internal structure of which can be seen in FIG. 3, which serves to provide a viscous drag upon oil which passes through it. It does this by presenting a large surface area to the oil so that the higher the viscosity of the oil, the greater the viscous drag which is imposed upon it.

The viscous restrictor 12 comprises a body 13 which serves to define a chamber 14 having an inlet 15 and outlet 16. The chamber 14 contains generally bullet-shaped centre body 17 which is supported from the walls of the chamber 14 by webs 18 so that the centre body 17 and the chamber 14 walls define an annular passage. The walls of the chamber 14 and the surface of the centre body 17 together provide a large surface area to oil passing through the restrictor 12. Consequently in view of the viscous drag which is imposed by this large surface area upon the oil passing over it, there is an oil pressure drop between the inlet 15 and the outlet 16. The pressure drop is proportional to the viscosity of the oil and since the oil's viscosity is determined by its temperature, the pressure drop is also proportional to the temperature of the oil.

When the oil leaves the viscous restrictor 12 through the outlet 16, it passes through a pipe 19 into a conventional heat exchanger 20. After passing through the matrix of the heat exchanger 20, it leaves the heat exchanger 20 through a pipe 21 to resume its lubrication duties.

The heat exchanger 20 is cooled by a flow of cooling air which is provided by a fan 22. The fan 22 is driven by means not shown to direct a flow of cooling air on to the heat exchanger 20 so as to provide cooling of the oil passing therethrough. The fan 22 is provided with a plurality of aerofoil blades 23 which are of variable pitch so as to provide a variable flow of cooling air on to the heat exchanger 20.

The pitch varying mechanism of the blades 23 is generally indicated at 24 and is in direct communication by means of an arm 25 with a piston 26 which is mounted for translation within a cylinder 27. The cylinder 27 is full of oil, and each side of the piston 26 is respectively in communication with the inlet 15 and outlet 16 of te viscous restrictor 12 so that the cylinder 27 is connected in parallel with the viscous restrictor 12.

Under normal operating conditions with hot oil passing into the oil cooler 10 through the pipe 11, the piston 26 is in the position shown in FIG. 1. In the position of the piston 26, the arm 25 is so disposed as to cause the pitch varying mechanism 24 to provide a coarse pitch on the fan blades 23. This results in a high flow rate of cooling air being directed on to the heat exchanger 20, thereby providing effective cooling of the hot oil before it leaves the oil cooler 10 through the pipe 21.

Figure 2:
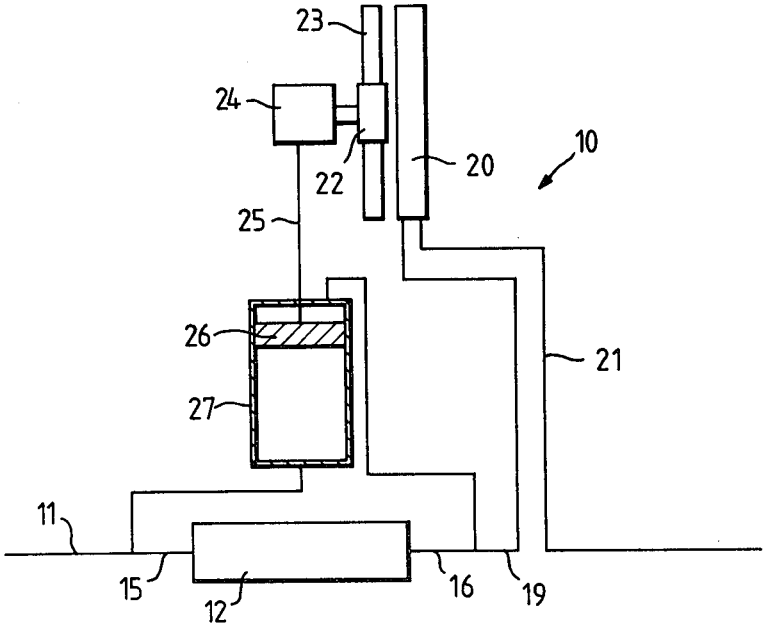
FIG. 2 is a further diagrammatic representation of an oil cooler in accordance with the present invention when in a different state than depicted in FIG. 1.

However if, as a result of operating conditions, the oil which enters the oil cooler 10 is cooler than the normal operating temperature of oil entering the oil cooler 10, then its viscosity will be higher than normal. This leads in turn to an increased pressure drop across the viscous restrictor 12. Since the cylinder 27 is connected in parallel with the viscous restrictor 12, the increase in the pressure drop across viscous restrictor results in the piston 26 being forced upwards to the position shown in FIG. 2. This results in turn in the actuation of the arm 25 to cause the pitch changing mechanism 24 to alter the pitch of the fan blades 23 to a fine setting, thereyby reducing the flow rate of the cooling air directed on to the heat exchanger 20. Consequently the oil which leaves the heat exchanger 20 through the pipe 21 is at a higher temperature then would have been the case if the cooling fan 22 had been of fixed pitch.

Similarly if the oil which enters the oil cooler 10 is hotter than normal, the pressure drop across the viscous restrictor will be reduced thereby resulting in the piston being forced downwards to a position in which the arm 25 will cause the pitch changing mechanism to alter the pitch of the fan blades 23 to a very coarse setting thereby providing increased cooling of the oil within the heat exchanger 20.

It will be seen therefore that the oil cooler 10 of the present invention provides a flow of cooling air to cool oil which passes through it, the flow rate of which is directly related to the viscosity, and hence temperature of the oil.

Although the oil cooler 10 of the present invention has been described with reference to an oil pressure difference detector which is constituted by a piston 26 and cylinder 27 assembly which actuates a variable pitch changing mechanism by means of a mechanical linkage constituted by the arm 25, it will be appreciated that a detector of a different form may be used. Thus for instance, the piston 26 and cylinder 27 assembly could be replaced by other suitable means capable of detecting pressure differences and the arm could be repalced by a non-mechanical system such as one which is based on the use of electrical signals.

It is envisaged that although the viscous restrictor 12 has been described as being an individual item, this need not necessarily be so. Thus the heat exchanger 20 may be so dimensioned that there is a pressure drop between its inlet and outlet. This being so, the heat exchanger 20, or part of it, could be used as the viscous restrictor with the cylinder 27 being mounted in parallel with it.

The oil cooler 10 of the present invention is particularly useful for providing cooling of the oil in the oil system of a gas turbine engine. Thus the oil coolers usually used for cooling oil in gas turbine engines are so adapted as to provide adequate oil cooling under those conditions at which the oil is at its hottest. Since such conditions only exist for a small proportion of the operating time of a gas turbine engine, the oil is usually overcooled for the remainder of the time thereby leading to inefficiencies in the operation of the engine. The oil cooler 10 of the present invention ensures that the oil is always cooled to the right temperature, thereby avoiding the problems usually associated with oil overcooling.

We claim:

1. An oil cooler comprising:

heat exchanger means for the passage of oil therethrough;

a driven fan positioned adjacent said heat exchanger means to direct a flow of cooling air onto said heat exchanger means for cooling any oil passing therethrough, said driven fan having variable pitch blades;

viscous restrictor means through which oil is passed, said viscous restrictor means having an inlet and an outlet and being capable of creating an oil pressure drop based on viscosity of oil passing therethrough;

oil pressure drop detection means connected in parallel with said inlet and said outlet of said viscous restrictor means, said oil pressure drop detection means including an output signal means for providing a signal proportional to oil pressure drop detected across said viscous restrictor means;

and means to vary pitch of said variable pitch blades of said driven fan, said last-mentioned pitch means being operatively connected and responsive to said output signal means of said oil pressure drop detector means whereby rate of flow of said flow of cooling air to said heat exchanger means increases with any decrease in oil pressure drop across said viscous restrictor means and vice versa.

2. An oil cooler as claimed in claim 1 wherein said oil pressure drop detection means comprises a cylinder having a piston translatable therein, each side of said piston being in communication with oil which is respectively in communication with the inlet and outlet of said viscous restrictor means, said piston also being in communication with said pitch varying means of said driven fan through said output signal means so that actuation of said piston as a result of changes in the oil pressure drop across the viscous restrictor means serves to cause a variation in the pitch of said fan.

3. An oil cooler as claimed in claim 1 wherein said viscous restrictor means comprises a member defining an elongate chamber with an inlet and an outlet and having internal walls, a body contained within said elongate chamber which, together with said internal walls of said chamber have a surface area to said oil passing therethrough which is of such magnitude as to provide a viscous drag on said oil which is sufficient to provide said oil pressure drop across said viscous restrictor means which oil pressure drop is proportional to the viscosity, and hence temperatures of said oil.

4. An oil cooler as claimed in claim 1 wherein said viscous restrictor means is constituted by at least part of said heat exchanger means.

* * * * *